US008132889B2

(12) United States Patent
McReynolds et al.

(10) Patent No.: US 8,132,889 B2
(45) Date of Patent: Mar. 13, 2012

(54) METHOD FOR DETECTING PURGING INK FLOW THROUGH PRINTHEAD HEATER CHIP NOZZLES BY THERMAL ANALYSIS

(75) Inventors: Jason Todd McReynolds, Georgetown, KY (US); Robert Henry Muyskens, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 653 days.

(21) Appl. No.: 12/270,991

(22) Filed: Nov. 14, 2008

(65) Prior Publication Data

US 2010/0123747 A1 May 20, 2010

(51) Int. Cl.
*B41J 2/165* (2006.01)

(52) U.S. Cl. ..... 347/23; 347/14; 347/26

(58) Field of Classification Search ..... 347/23, 347/26

See application file for complete search history.

(56) References Cited

U.S. PATENT DOCUMENTS

| | | | | |
|---|---|---|---|---|
| 5,745,132 | A * | 4/1998 | Hirabayashi et al. | 347/14 |
| 5,751,304 | A * | 5/1998 | Hirabayashi et al. | 347/17 |
| 5,946,007 | A * | 8/1999 | Otsuka et al. | 347/23 |
| 6,394,571 | B1 * | 5/2002 | Yano et al. | 347/17 |
| 6,517,185 | B1 | 2/2003 | Aldrich | |
| 6,719,395 | B2 * | 4/2004 | Iwasaki et al. | 347/23 |
| 7,131,714 | B2 | 11/2006 | Edelen et al. | |
| 7,168,799 | B2 | 1/2007 | Benson et al. | |
| 7,806,503 | B2 * | 10/2010 | Aoki et al. | 347/23 |
| 2002/0063745 | A1 * | 5/2002 | Osborne | 347/19 |
| 2006/0023016 | A1 * | 2/2006 | Bellinger et al. | 347/17 |

* cited by examiner

*Primary Examiner* — Charlie Peng

(57) ABSTRACT

A method for detecting ink flow through a printhead, due to a successful purging of the nozzles of a heater chip of the printhead, includes moving the printhead to a location in preparation for a purging operation such that a purge pump is connected in flow communication with heater chip nozzles, setting the manner in which the purge pump operates to suction ink through nozzles of the heater chip from a source of ink, performing a thermal analysis on the heater chip concurrently as the purge pump operates to determine whether ink is flowing through the heater chip nozzles and whether the purge pump should continue to operate, and adjusting the manner in which the purge pump continues to operate in response to the thermal analysis.

5 Claims, 7 Drawing Sheets

METHOD FOR DETECTING PURGING INK FLOW THROUGH PRINTHEAD HEATER CHIP NOZZLES BY THERMAL ANALYSIS

CROSS REFERENCES TO RELATED APPLICATIONS

This patent application is related to copending U.S. patent application Ser. No. 11/517,931, filed Sep. 8, 2006, entitled "Actuator Chip for Micro-Fluid Ejection Device with Temperature Sensing and Control Per Chip Zone" and assigned to the assignee of the present invention. The disclosure of this patent application is hereby incorporated herein by reference.

BACKGROUND

1. Field of the Invention

The present invention relates generally to inkjet printhead maintenance and, more particularly, to a method for detecting purging ink flow through printhead heater chip nozzles by firmware thermal analysis to enhance inkjet printhead maintenance.

2. Description of the Related Art

Thermal inkjet printers typically monitor the temperature of their printheads while printing. These printers can use a variety of temperature sensing methods to determine the temperature of any number of regions on the printheads. For example, as disclosed in the patent application cross-referenced above, many printers analyze the temperature by zone, where given zones are used to determine the temperature of a specific color or ink flow via.

Printheads can often be damaged, having degraded print quality, when air is ingested into their nozzles, vias and ink flow channels. Printheads can also show degraded print quality when their nozzles are clogged with dried ink or other contaminants. To manage both of these cases, and provide the ability to recover from these and other failures, printers will often implement a purge pump, typically taking the form of a peristaltic pump. The purge pump will attempt to draw or suction ink from the printhead nozzles in an attempt to clear the air or other clogs.

Another approach to printhead maintenance is to use a method of electrostatic detection of malfunctioning nozzles. This allows a determination of when maintenance operations need to be performed to improve the operational condition of the printhead nozzles. By using this method, the user is able to determine whether a purge cycle was successful in removing a clog, or if performing a second purge cycle is necessary.

Notwithstanding the existence of the aforementioned approaches, there is still a need for an innovation that will further enhance inkjet printhead maintenance.

SUMMARY OF INVENTION

The present invention improves upon the prior art by providing an innovation that takes different approaches to enhancing inkjet printhead maintenance. Various embodiments evaluate the success of a printhead purge operation at the printer maintenance station by using firmware stored in the printer controller that controls inkjet printhead maintenance. The firmware performs a thermal analysis of the printhead heater chip and makes corresponding self-adjustments. The thermal analysis that is undertaken in these approaches is performed on a thermal inkjet printer by employment of temperature sense resistor(s) already present in the heater chip of the printhead.

Accordingly, in an aspect of the present invention, a method for detecting purging ink flow through printhead heater chip nozzles includes moving the printhead to a location in preparation for a purging operation such that a purge pump is connected in flow communication with the heater chip nozzles, setting the manner in which the purge pump operates to suction ink through nozzles of the heater chip from a source of ink, performing a thermal analysis on the heater chip concurrently as the purge pump operates to determine whether ink is flowing through the heater chip nozzles and whether the purge pump should continue to operate, and adjusting the manner in which the purge pump continues to operate in response to the thermal analysis.

In a first embodiment of the method of the present invention, setting the manner in which the purge pump operates includes setting firmware in a controller such that the controller attempts to maintain the heater chip at a substantially constant temperature, and performing thermal analysis includes simultaneously monitoring the intensity of heating/energy produced by the heater chip to substantially maintain that temperature so as determine whether ink movement is occurring through the nozzles of the heater chip.

In a second embodiment of the method of the present invention, setting the manner in which the purge pump operates includes setting firmware in a controller such that the controller applies a substantially constant intensity of heating/energy to the heater chip, and performing thermal analysis includes simultaneously monitoring changes in temperature to determine whether ink movement is occurring through the nozzles of the heater chip.

BRIEF DESCRIPTION OF THE DRAWINGS

Figure 1:
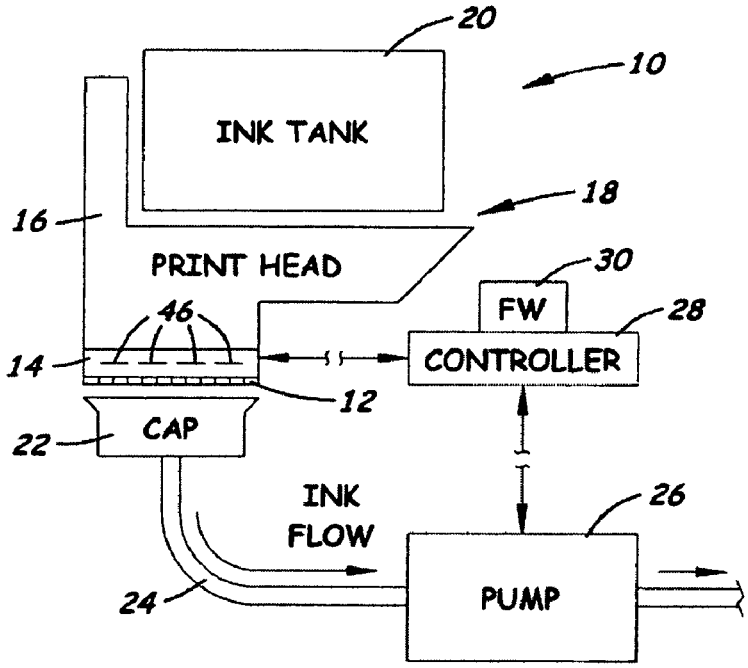

Having thus described the invention in general terms, reference will now be made to the accompanying drawings, which are not necessarily drawn to scale, and wherein:

FIG. 1 is a diagrammatic representation of an inkjet printhead disposed at a maintenance station of a printer and connected to a purge pump via a cap device at the station with firmware stored in a controller of the printer analyzing in accordance with the present invention and controlling the speed of operation of the pump in performing a purge operation on the heater chip nozzles of the printhead.

Figure 2:
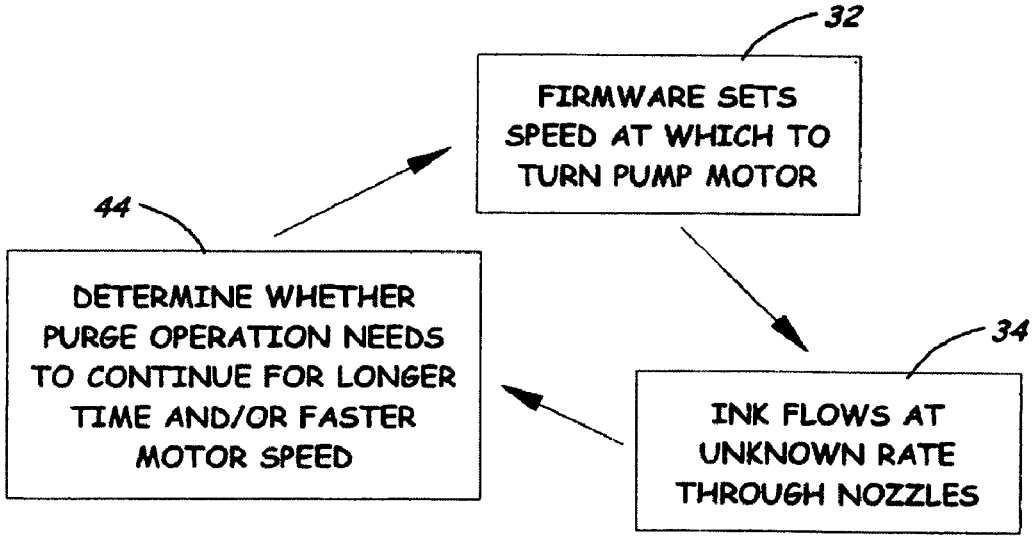

FIG. 2 is a closed loop flow chart wherein a thermal analysis of the purge operation by the firmware in accordance with the present invention provides feedback to the controller of the flow rate of ink through the heater chip nozzles to determine whether purge operations needs to continue for longer time and/or at faster pump motor speed.

Figure 3:
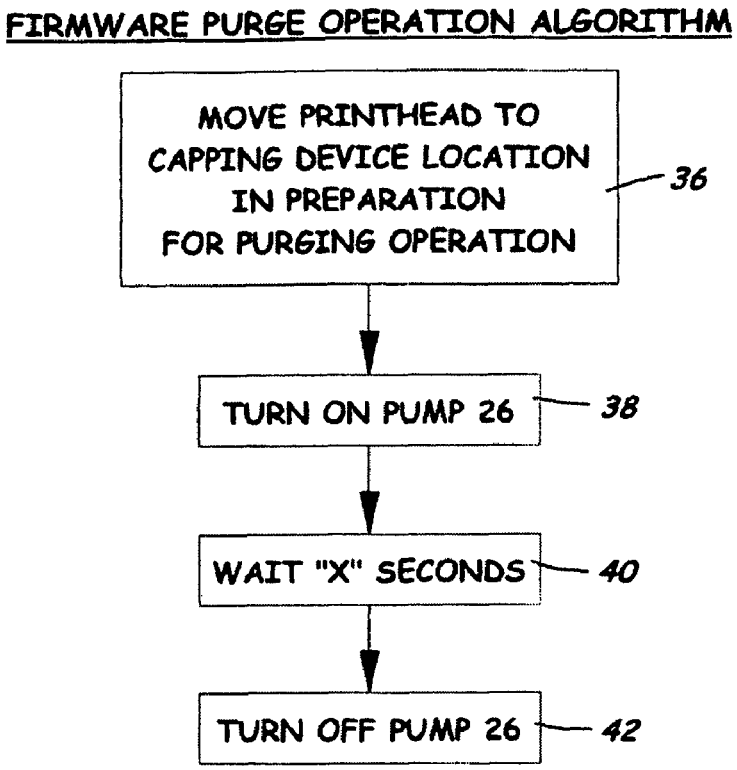
Fig. 3 (PRIOR ART)

FIG. 3 is a flow chart of a prior art firmware purge operation algorithm that was used prior to implementation of the thermal analysis of the purge operation in accordance with the present invention.

Figure 4:
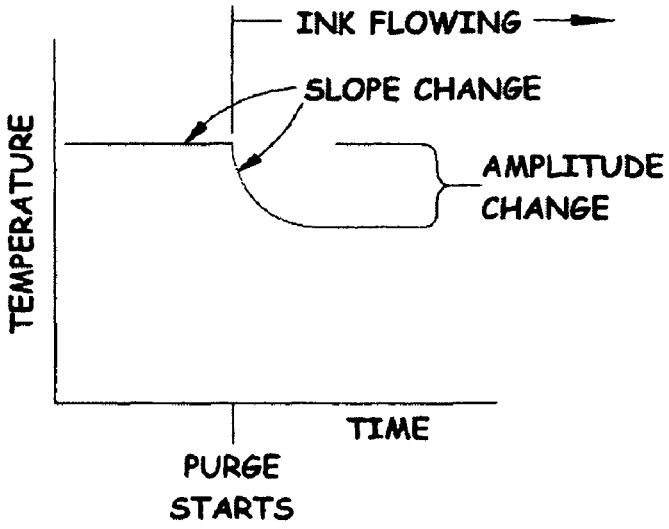

FIG. 4 is a graph illustrating the change of amplitude of a temperature curve or the change of slope of a temperature or intensity curve over time which changes are detected and used in the thermal analysis performed in accordance with the method of the present invention for detecting ink flow through printhead heater chip nozzles due to the purge operation.

Figure 5:
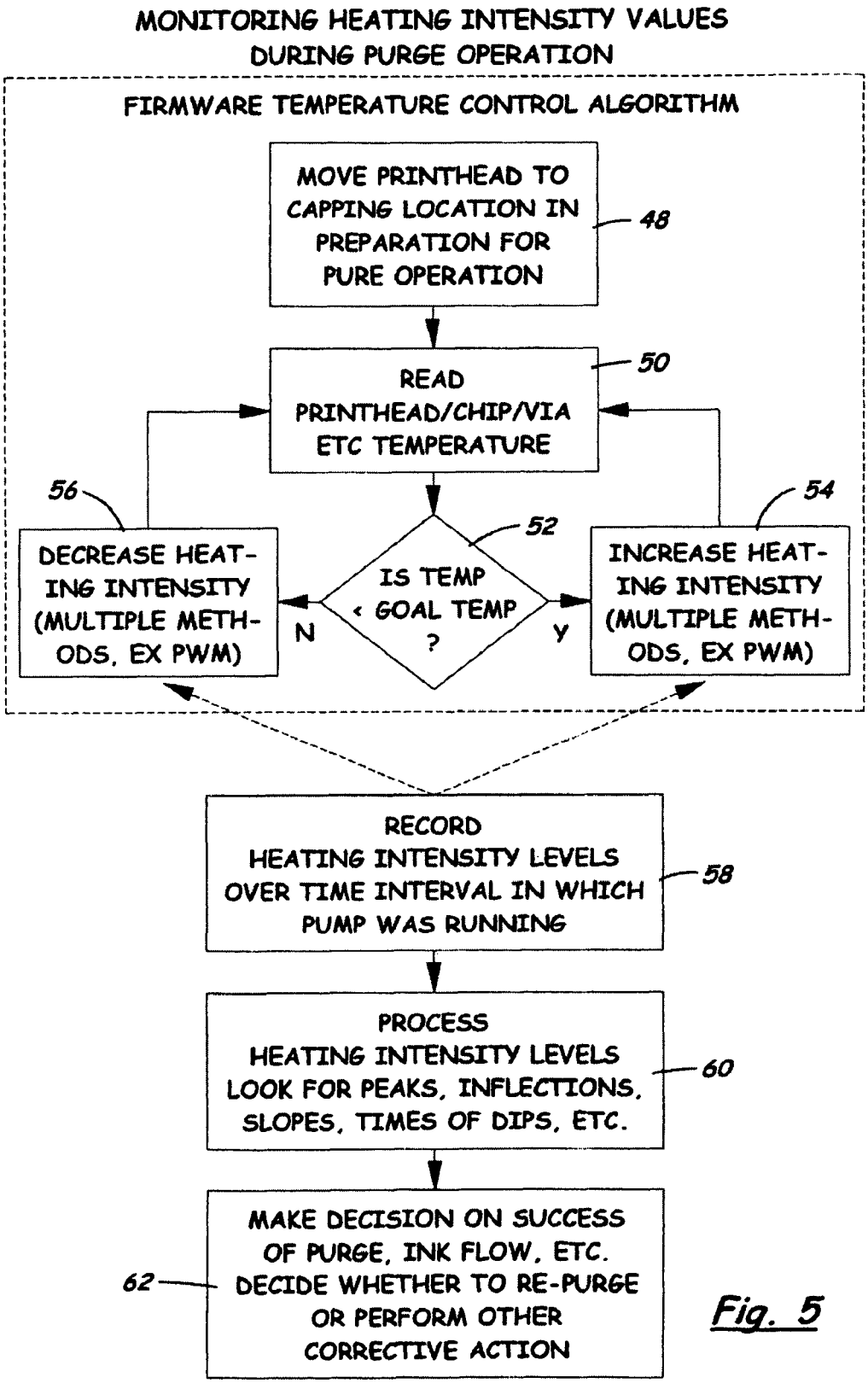

FIG. 5 is a flow chart of a first embodiment of the method of the present invention for detecting ink flow though printhead heater chip nozzles due to the purge operation utilizing monitoring the heating intensity values while attempting to maintain a constant temperature of the heater chip during the purge operation.

Figure 6:
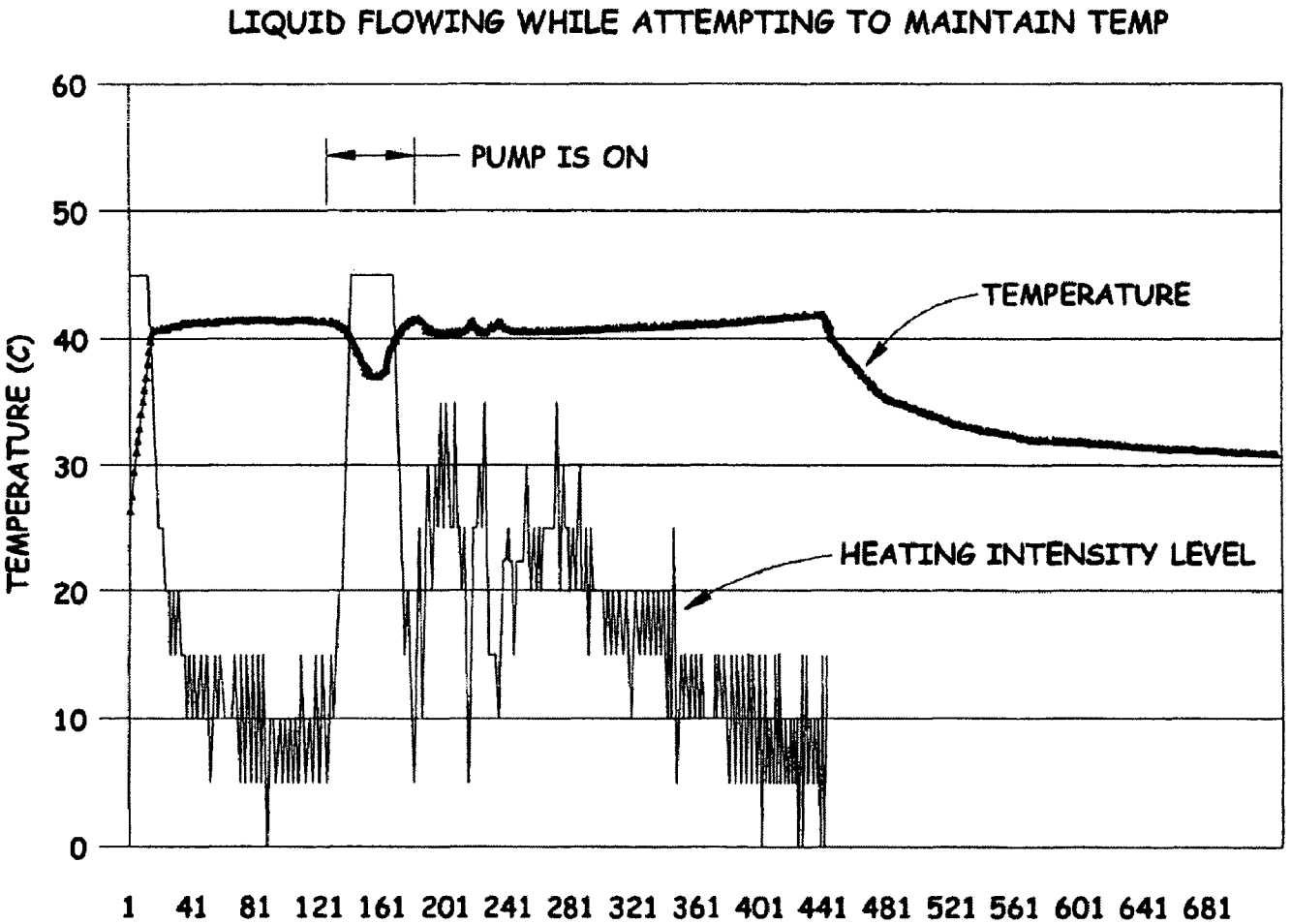

FIG. 6 is a graph depicting the relationship of change of the slope of intensity over time at constant temperature as occurs in the first embodiment of the method of the present invention depicted in FIG. 5.

Figure 7:
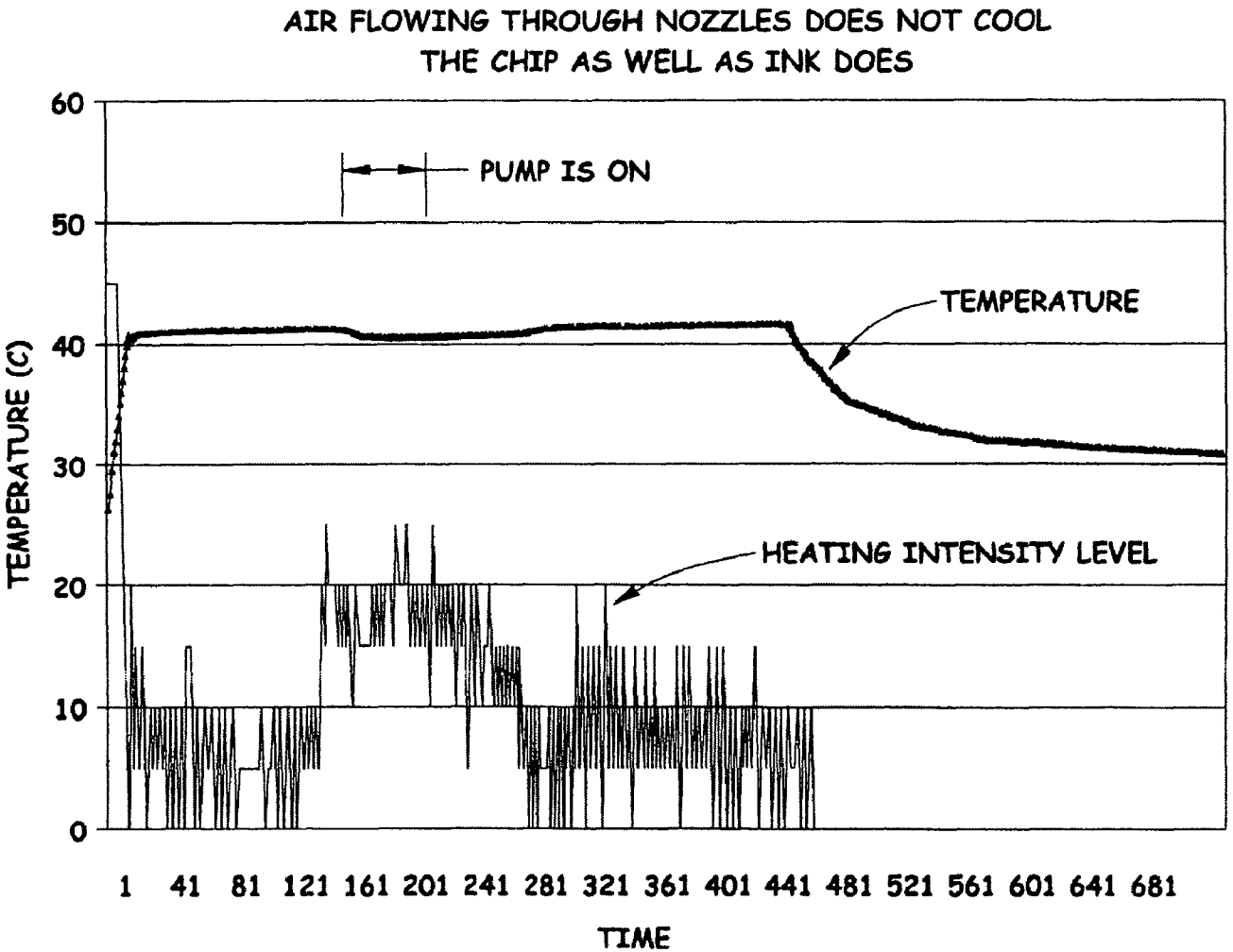

FIG. 7 is a graph similar to that of FIG. 6 but depicting the curves where air is flowing through the printhead heater chip during the purge operation compared to liquid (ink) flowing through the printhead heater chip during the purge operation as depicted in FIG. 6.

Figure 8:
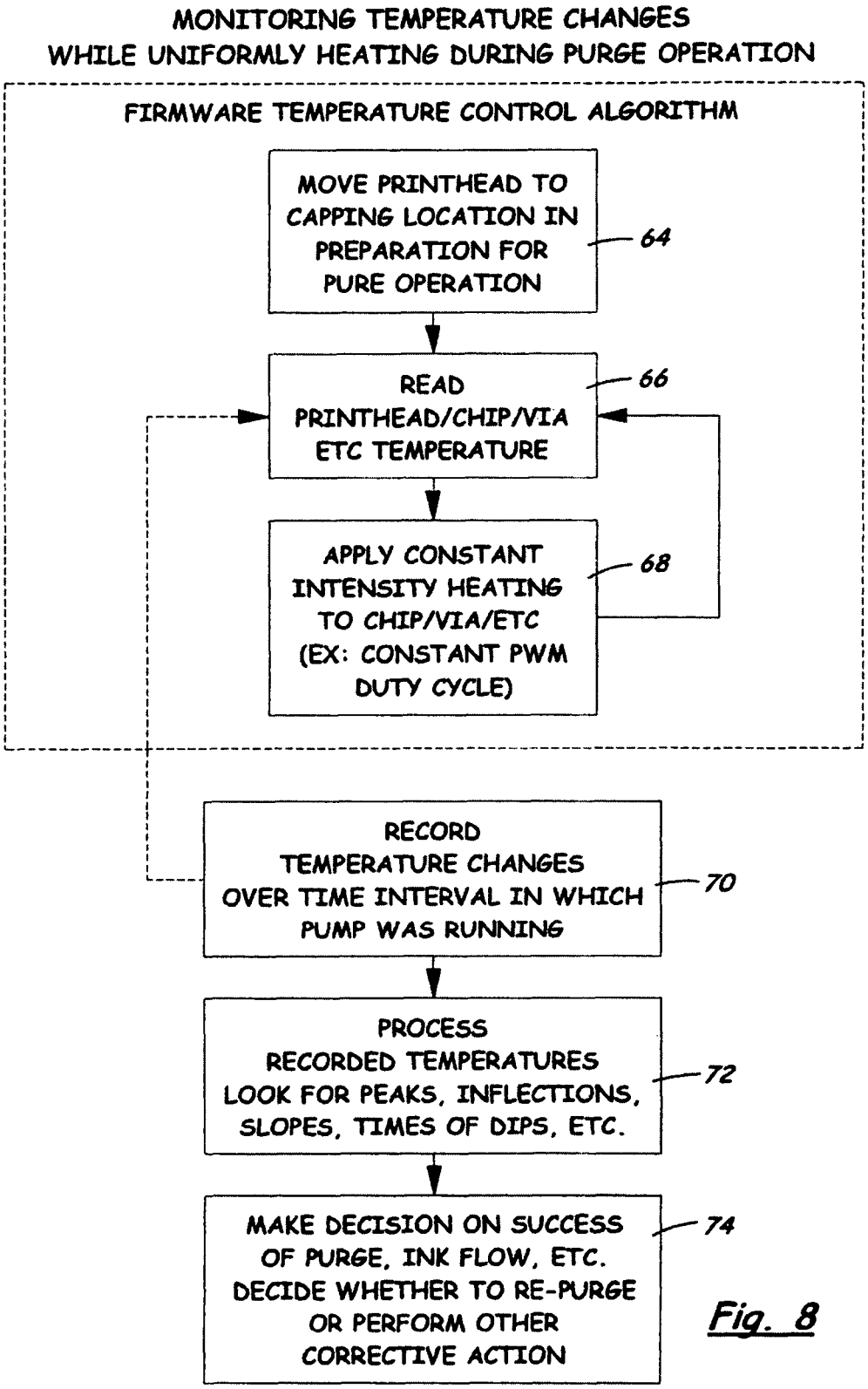

FIG. 8 is a flow chart of a second embodiment of the method of the present invention for detecting ink flow through the printhead heater chip nozzles due to the purge operation utilizing monitoring the temperature change while uniformly heating the heater chip during the purge operation.

Figure 9:
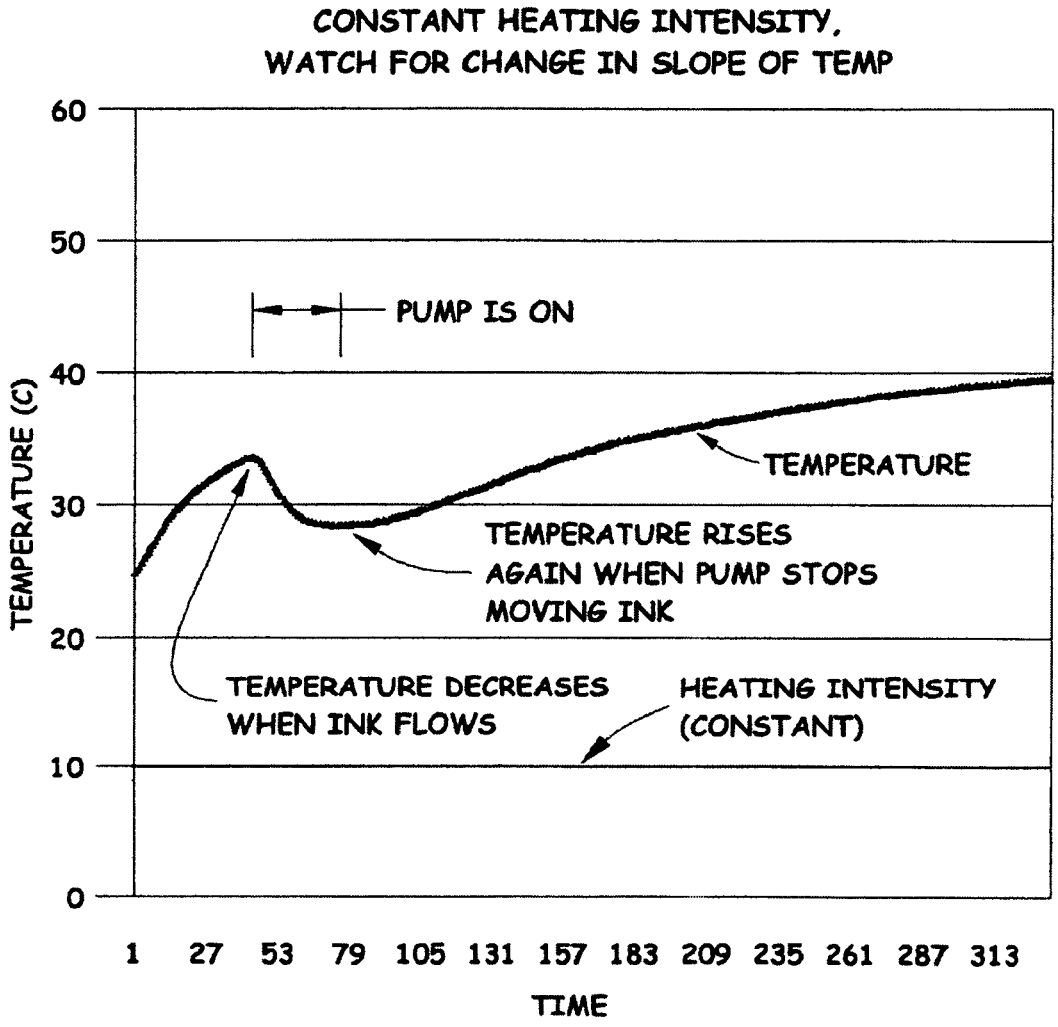

FIG. 9 is a graph depicting the relationship of change of slope of temperature over time at constant heating intensity as occurs in the second embodiment of the method of the present invention depicted in FIG. 8.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIG. 1, there is schematically illustrated a maintenance station, generally designated 10, of an imaging machine in the form of a thermal inkjet printer, for performing maintenance operations on ink ejection holes or nozzles 12 in a heater chip 14 of an inkjet printhead 16. The printhead 16 is part of a printhead assembly 18 which also includes an ink tank 20 for supplying ink to the printhead 16. The maintenance station 10, among its various components, includes a printhead capping device 22 connected by a hose 24 to a purge pump 26, which, by way of example but not limitation, may be a peristaltic pump. Details of an exemplary embodiment of a maintenance station are disclosed in U.S. Pat. No. 6,517,185 assigned to the assignee of the present invention. The disclosure of this patent is hereby incorporated herein by reference.

The inkjet printer also includes a controller 28 which, in addition to being connected to and controlling the operations of all other of the operative components of the printer, is connected to and controls the operation of the pump 26 in purging the nozzles 12 of the printhead heater chip 14. Details of an exemplary embodiment of an inkjet printer having a controller are disclosed in U.S. Pat. No. 7,168,799 also assigned to the assignee of the present invention. The disclosure of this patent is hereby incorporated herein by reference. Typically, as is well-known, the printer controller 28 basically includes a microprocessor with an associated random access memory (RAM) and a read only memory (ROM) which interact and cooperate with one another to carry out the operations of the controller 28. The controller 28 executes a sequence of program instructions to cause the printing of an image on a print media sheet. Also, the controller 28 stores firmware 30 that provides program instructions which the controller 28 executes to control performance of operations such as that of the purge pump 26 in causing a purge operation to be performed on the nozzles 12 of the printhead heater chip 14 at the maintenance station 10.

Heretofore, the use of the purge pump 26 in an effective manner was a balancing act where some assumptions have to be made. The fluid flow rate of the purge pump 26 as well as the pressure of the pump 26 should be monitored to ensure the best chance of printhead nozzle recovery. However, in the standard operation of performing the purge, the pump 26, as represented by the sequence of blocks 32 and 34 of FIG. 2, operates in an "open loop" in the sense that the pump 26 attempts to move ink at a specific flow rate and resulting pressure through the printhead heater chip 14. However, the firmware 30 stored in the printer controller 28, as per block 32, sets the speed of the pump 26 but, as per block 34 is not capable of measuring the actual ink flow, and thus not capable of determining the success of the purge through the printhead nozzles 12 to know whether or not a faster pump speed or longer purging cycle, among other possible responses, is actually needed in order to reach the desired ink flow rate through the nozzles 12 of the printhead heater chip 14. Heretofore, the firmware 30 stored in the controller 28 operated in accordance with a purge operation algorithm, depicted in FIG. 3. As per block 36, the firmware 30 commands the printhead 16 to move to the location of the capping device 22 in the maintenance station 10 in preparation for the purge operation. Then, to operate the purge pump 26 in performance of the purge operation, the firmware performs the following sequence of steps: first, turns on the purge pump 26, as per block 38; next, waits "x" number of seconds, as per block 40; and, then, turns off the purge pump 26, as per block 42. There is no monitoring of the purge pump 26 during its operation to determine the success of the purge operation performed on the printhead nozzles 12.

A thermal analysis now performed by the firmware 30 stored in the controller 28, upgraded in accordance with an embodiment of the present invention, closes the open loop, as per block 44 in FIG. 2, by determining whether or not there is a flow of ink due to the purge operation and whether or not the purge operations needs to continue for a longer time and/or at a faster motor speed and feeds back and self-adjusts accordingly. The firmware-based thermal analysis is implemented, in accordance with two embodiments of the method of the present invention disclosed hereinafter, through employment of a TSR 46 already present in the heater chip 14 of the printhead 16. Details of an exemplary embodiment of the heater chip of an inkjet printhead with a TSR are disclosed in U.S. Pat. No. 7,131,714 assigned to the assignee of the present invention. The disclosure of this patent is hereby incorporated herein by reference. The present invention takes advantage of the fact that the printhead 16 uses a closed loop control system to maintain a desired temperature of ink in the firing chambers of the printhead 16 adjacent the nozzles 12. The heater chip 14 of the thermal inkjet printhead has heater elements (not shown) responsive to repetitive electrical activation and deactivation to produce cycles of heat-up and cool-down which are intended to result in cycles of fluid ejection from the nozzles 12. The thermal analysis of the thermal purge operation by the firmware 30 stored in the controller 28, in accordance with embodiments of the method of the present invention, capitalizes on the fact the heater chip 14 will be cooler during a heating operation when the purge pump 26 suctions ink through the nozzles 12 of the heater chip 14. This occurs because the purge pump 26 is suctioning hot ink from the nozzles 12 and replacing it with cooler ink from the ink tank 20 which cools the heater chip 14.

As mentioned above, the method of the present invention may employ either one of the two disclosed embodiments (and variations that will be obvious to one of ordinary skill in the art) for detecting ink flow through the nozzles of the printhead 14 due to the purge operation, as depicted in the flow charts of FIGS. 5 and 8. The first embodiment is to set the firmware 30 in the controller 28 such that the controller 28 attempts to maintain a constant temperature at the firing chamber/via of the printhead heater chip 14 and also to monitor the intensity of heating/energy that is being produced by heater elements of the printhead heater chip 14 in order to maintain that temperature. The second approach is to set the firmware 30 in the controller 28 such that the controller 28 applies a constant heating/energy intensity to the heater elements of the printhead heater chip 14 and monitors for changes in temperature which occur during ink movement through the nozzles of the printhead 16. These two embodiments may be used individually or combined under some implementations. Under each embodiment, various interpretation or analysis techniques may be used. Referring to FIG. 4, it can be realized that a change in slope of the temperature or intensity curve may be analyzed, or the direct amplitude variation or change may be analyzed. Either embodiment may be used to detect ink flow through the nozzles 12 due to the purge operation. In either embodiment, the values of the slope of the curves monitored turn negative or, in other words, due to the start of a successful purge operation the temperature decreases.

Referring now to the flow chart of FIG. 5, there is depicted an exemplary first embodiment of the method of the present invention. In the first embodiment, the firmware 30 stored in the controller 28 is set to attempt to heat and maintain a substantially constant temperature of the heater chip 14 and monitor the response, that is, the intensity of heating/energy produced by the heater chip 14 to substantially maintain that temperature so as determine whether ink movement is occurring through the nozzles 12 of the heater chip 14. More particularly, as per block 48, the firmware 30 in the controller 28 causes the printhead 16 to move to the capping location in the maintenance station 10 in preparation for the purging operation. As per block 50, the firmware 30 then reads the temperature of the heater chip 16 (and adjacent via), compares it to the temperature target or goal and decides, as per block 52, if the temperature is less than the target/goal to increase the heating intensity, as per block 54, or if the temperature is greater than the target/goal to decrease the heating intensity, as per block 56. Various methods can be used to increase or decrease the heating intensity. Next, as per block 58, the firmware 30 records the heating intensity levels over the time interval in which the purge pump 26 is running. Instead of recording the data, "on-the-fly" processing of the data may be performed depending on the type of processing desired/needed for specific purge decisions. Then, as per block 60, the heating intensity levels are processed by looking for peaks, inflections, slopes, times of "dips", etc. Finally, as per block 62, a decision is made on the success of the purge operation through the printhead nozzles 12 in terms of ink flow due to the purge operation and whether or not re-purge or some other corrective or self-adjustment action needs to be taken by the firmware 30, such as, set a faster pump speed or longer purging cycle.

The graph of FIG. 6 is a plot of the data collected and recorded by the firmware 30 stored in the controller 28 during the purge operation. The smooth trace is the temperature of the heater chip 14 of the printhead 16 while the jagged trace is the heating intensity level of the heater chip 14. When the purge pump 26 turns on, the firmware 30 quickly spikes the heating intensity, but as can be seen in the plot the heating intensity still has difficulty maintaining the temperature target or goal and thus the temperature on the heater chip 14 of the printhead 16 drops or dips. FIG. 6 also shows the case where both the intensity level and the temperature could be monitored to determine that ink was flowing. It is also possible to see how this first embodiment of the method of the present invention may be used to determine whether specific color vias on the heater chip 14 are being purged better than other vias. Using the first embodiment of the method, the firmware 30 stored in the controller 28 is able to actively monitor the purge operation success of different vias and if desired it could continue purging until the worst performing vias are properly purging or flowing ink. It also can be seen that it is possible to detect the ink flow in a nearby via even when those vias are not directly being heated. The heat from a nearby via still warms the ink enough that a change can be seen when ink flows.

The graph in FIG. 6 also represents liquid (ink) flowing through the printhead nozzles 12 while attempting to maintain temperature constant. The graph in FIG. 7 represents only air flowing through the printhead nozzles 12 while attempting to maintain temperature constant. Thus, these two graphs show how the thermal analysis differs when ink is present in the printhead nozzles 12 versus when the ink is empty or missing and only air is flowing. It is because air does not remove the heat from the printhead heater chip 14 as effectively as the ink, that one can see in FIG. 7 that the temperature is able to maintain itself closer to an exemplary target or goal of 42° C. In comparison to the case of ink flowing in FIG. 6, the heating intensities do not spike for as long when only air flows. One can imagine that in the extreme case where many of the printhead nozzles 12 (or a whole via) are clogged and preventing ink flow, the temperature would not drop during a purge operation because no ink was able to flow and cool the nozzles 12.

Referring now to the flow chart of FIG. 8, there is depicted an exemplary second embodiment of the method of the present invention. In the second embodiment, the firmware 30 stored in the controller 28 is set such that the controller 28 applies a constant intensity of heating/energy to the heater chip 14 and simultaneously monitors changes in temperature to determine whether ink movement is occurring through the nozzles 12 of the heater chip 14 and whether the purge pump 26 should continue to operate. More particularly, as per block 64, the firmware 30 in the controller 28 causes the printhead 16 to move to the capping location in the maintenance station 10 in preparation for the purging operation. As per block 66, the firmware 30 then reads or monitors the temperature of the heater chip 16 (and adjacent via) and, as per block 68, and is set to apply a substantially constant intensity of heating/energy to the heater chip 14 (and via) to power the heating elements thereof and also simultaneously continues to monitor the change in temperature slope of the heater chip 14. Various methods can be used to apply the substantially constant heating intensity. Next, as per block 70, the firmware 30 records the temperature changes over the time interval in which the purge pump 26 is running. Instead of recording the data, "on-the-fly" processing of the data may be performed depending on the type of processing desired/needed for specific purge decisions. Then, as per block 72, the temperatures are processed by looking for peaks, inflections, slopes, times of "dips", etc. Finally, as per block 74, a decision is made on the success of the purge operation through the printhead nozzles 12 in terms of ink flow due to the purge operation and whether or not re-purge or some other corrective or self-adjustment action needs to be taken by the firmware 30, such as, set a faster pump speed or longer purging cycle.

The graph of FIG. 9 is a plot of the data collected and recorded by the firmware 30 stored in the controller 28 during the purge operation. The graph shows a case in which the temperature is rising due to the substantially constant heating intensity until the purge pump 26 is turned on. When the purge pump 26 turns on, and ink begins to flow, the slope of the temperature curve changes. One can see that in general the purge pump 26 is on and ink is flowing while the temperature is decreasing, and the pump 26 is off at the times the temperature is rising. Also, it can be realized that the flow rate through the nozzles 12 caused by the purge pump 26 is correlated to the slope of the temperature curve. If ink is slowly flowing through the nozzles 12, the temperature will not change as rapidly as when the ink flows quickly.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A method for detecting purging ink flow through printhead heater chip nozzles, comprising:

moving a printhead to a maintenance location in preparation for a purging operation by a purge pump, the purge pump being in flow communication with nozzles of a heater chip of the printhead;

monitoring, at a printer controller, the intensity of energy produced by the heater chip, wherein the printer controller monitors the intensity of energy produced by the heater chip and attempts to maintain substantially a constant heater chip temperature during the purging operation; and adjusting the purge pump operation in response to instructions from the printer controller.

2. The method of claim 1 wherein the step of monitoring the intensity of energy produced by the chip further includes an analysis of whether ink is flowing through the printhead during the purging operation.

3. The method of claim 1 wherein the step of monitoring the intensity of energy produced by the chip includes:

analyzing a change in slope of an intensity curve; and correlating an ink flow rate to the change in the slope of the intensity curve.

4. The method of claim 1, wherein the step of adjusting the purge process includes:

performing a thermal analysis of the heater chip;

making a decision on a status of the purging operation; and sending instructions regarding whether to continue purging or whether to adjust the purge pump speed.

5. A method for detecting purging ink flow through printhead heater chip nozzles, comprising:

moving a printhead to a maintenance location in preparation for a purging operation by a purge pump, the purge pump being in flow communication with nozzles of a heater chip of the printhead;

monitoring, at a printer controller, the intensity of energy produced by the heater chip; and adjusting the purge pump operation in response to instructions from the printer controller, wherein monitoring the intensity of energy produced by the chip includes analyzing a change in slope of an intensity curve; and correlating an ink flow rate to the change in the slope of the intensity curve.

* * * * *